US011022075B1

(12) United States Patent
Scoggins

(10) Patent No.: US 11,022,075 B1
(45) Date of Patent: Jun. 1, 2021

(54) ENHANCED FUEL DELIVERY SYSTEM

(71) Applicant: Darrell Scoggins, Bowling Green, KY (US)

(72) Inventor: Darrell Scoggins, Bowling Green, KY (US)

( * ) Notice: Subject to any disclaimer, the term of this patent is extended or adjusted under 35 U.S.C. 154(b) by 83 days.

(21) Appl. No.: 16/266,206

(22) Filed: Feb. 4, 2019

(51) Int. Cl.
*F02M 17/24* (2006.01)
*F02M 17/40* (2006.01)
*F02M 15/02* (2006.01)

(52) U.S. Cl.
CPC ..... *F02M 17/24* (2013.01); *F02M 15/025* (2013.01); *F02M 17/40* (2013.01)

(58) Field of Classification Search
CPC .. F02M 17/24; F23D 3/02; F23D 3/18; F23D 3/22; F23D 3/24; F23D 3/40
USPC ..... 123/523, 524; 413/241
See application file for complete search history.

(56) References Cited

U.S. PATENT DOCUMENTS 1,067,582 A * 7/1913 Maxim ..... F02M 31/18 48/107
4,246,878 A * 1/1981 Tuzson ..... F02M 7/106 123/523
4,469,075 A * 9/1984 Jackson ..... F02M 17/20 123/523
5,427,077 A * 6/1995 Gilbert ..... F02M 17/22 123/522
7,942,644 B2 * 5/2011 Young ..... F04B 17/00 417/208
2010/0021855 A1 * 1/2010 Requejo ..... F23D 3/22 431/291

FOREIGN PATENT DOCUMENTS

FR 475335 A * 5/1915 ..... F02M 17/24
JP 60144513 A * 7/1985 ..... F23D 3/18

* cited by examiner

*Primary Examiner* — Jacob M Amick
*Assistant Examiner* — Michael A Kessler
(74) *Attorney, Agent, or Firm* — Mark F. Smith; Smith Brandenborg Ltd

(57) ABSTRACT

An enhanced fuel delivery system having a fuel storage container for storing a quantity of liquid fuel and a vaporization vessel with an enclosed inner cavity having a central core structure with one or more openings and an inner core passage connected to a fuel line of a reciprocating engine, wherein liquid fuel is directed from the fuel storage container to the vaporization vessel and is drawn through the wicking material and converted into a vapor state where the fuel vapor is directed through the one or more openings to the inner core passage and out through the fuel line to be introduced into the combustion chamber of the reciprocating engine.

20 Claims, 8 Drawing Sheets

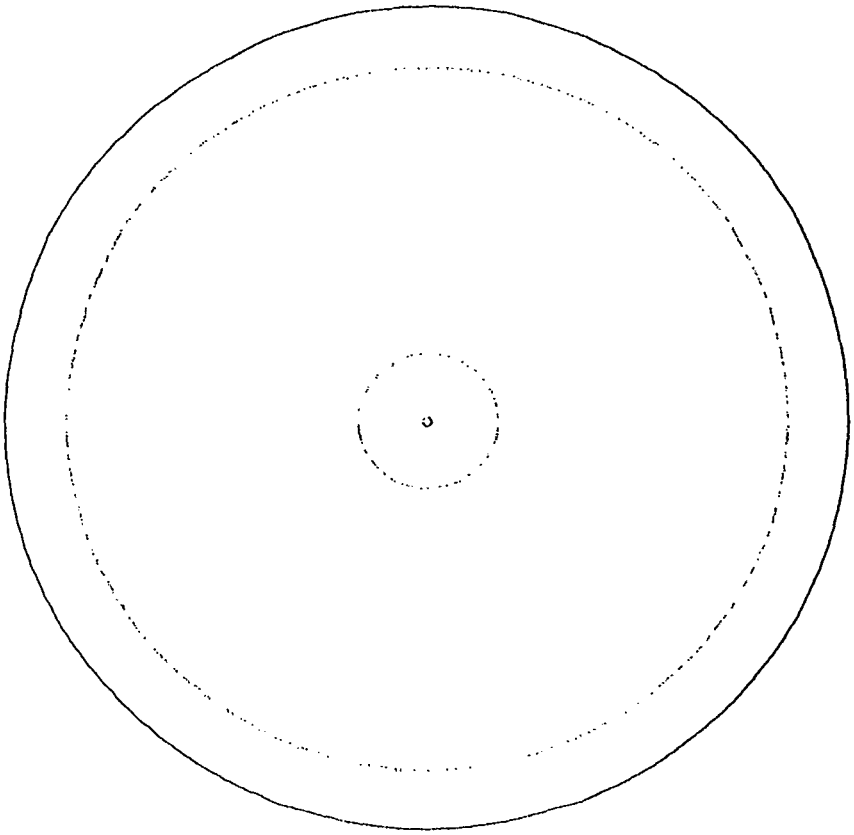
FIG 5
FIG 4
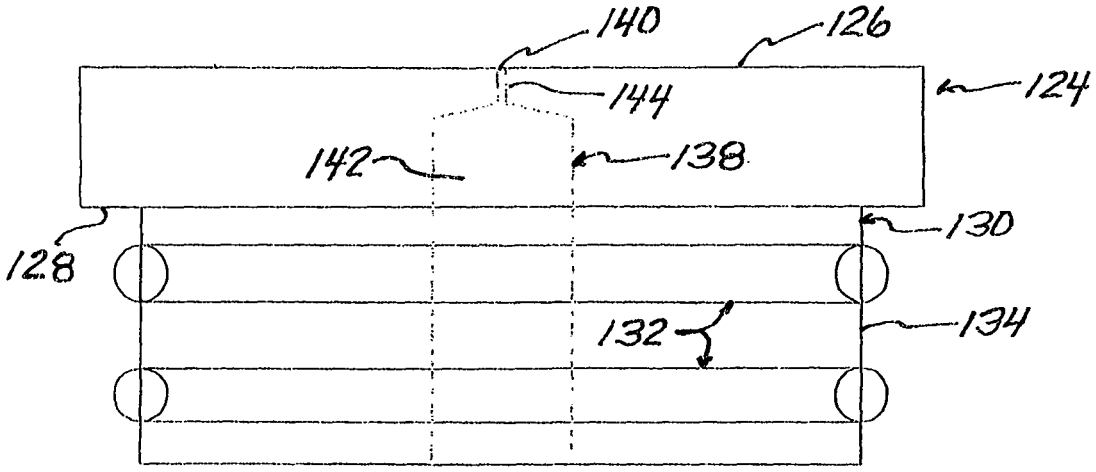

ENHANCED FUEL DELIVERY SYSTEM

BACKGROUND OF THE INVENTION

The present invention is directed to a system for use with a reciprocating engine and, more particularly, to an enhanced fuel delivery system for use with a reciprocating engine that is effective for improving fuel usage.

Standard reciprocating engines, such as internal combustion engines, rely upon a pressure differential to move a fuel/air mixture into a combustion chamber associated with each engine cylinder. During an intake stroke of a piston of a conventional engine, the piston recedes in the cylinder bore and an inlet valve is simultaneously opened at the inlet port to admit the fuel/air mixture. A receding piston creates a partial vacuum in the combustion chamber and throughout the intake manifold. This vacuum operates to draw air through into the combustion chamber were a fuel injector system (or carburetor system) operates to spray liquid fuel droplets into the air to create a misty fuel/air mixture.

The nature and quality of the combustion of the liquid fuel and air mixture in the combustion chamber depends on numerous factors. One of the most significant of these factors is the degree to which the liquid fuel droplets released by the fuel injectors (or carburetor) are atomized and vaporized on their way to or within the combustion chamber. Ideally, the fuel/air mixture in the combustion chamber should be in a gaseous state. However, this is not currently achievable in conventional internal combustion engines. Accordingly, fuel in a liquid state, is typically suspended in the combustion chamber as a mist or droplets, and will often not ignite. Such un-vaporized fuel that does not burn completely during the combustion stroke of the cylinders is then expelled into the engine exhaust system where it continues to burn, heating the engine and requiring surplus pollution control devices or it is vaporized and exhausted into the atmosphere thereby wasting fuel and adds to air pollution.

Accordingly, it would be desirable to have a system whereby fuel can be stored in its liquid state and converted into a vapor state prior to being introduced into the combustion chamber of a reciprocating engine thereby increasing combustion efficiency and reducing fuel consumption and air pollution.

SUMMARY OF THE INVENTION

The subject invention is to an enhanced fuel delivery system for use with a reciprocating engine that is effective for improving fuel usage and reducing air pollution. The system comprises a fuel storage container for providing and storing a quantity of liquid fuel, a vaporization vessel connected to the fuel storage container through a fuel supply channel that operates to transfer liquid fuel stored in the fuel storage container to flow into the vaporization vessel. The vaporization vessel includes a central core structure and wicking material, whereby the wicking material operates to draw the liquid fuel entering the vaporization vessel to spread the liquid fuel to increase the surface area of the fuel exposed to air within the vaporization vessel thereby transforming the liquid fuel into vapor. The vapor is then directed through one or more openings in the central core structure to an inner core passage and out to a fuel line that operates to direct the vapor to a fuel intake of the reciprocating engine.

In a preferred embodiment of the invention, the vaporization vessel has an upper vessel component, a bottom vessel end and a vaporization body having an outer vessel surface and an inner vessel surface and extends longitudinally from the top component to the bottom vessel end wall that together define an enclosed inner cavity. The top component includes a plurality of apertures that operate to direct air from outside the vaporization vessel ("atmospheric air") to enter the enclosed inner cavity. The inner vessel surface of the vaporization body has a smooth continuous rounded configuration such that it is effective for maintaining a smooth air flow (laminar air flow) within the enclosed inner cavity (or minimizing the amount of turbulent air flow within the enclosed inner cavity).

In a preferred embodiment of the invention the plurality of apertures formed along the upper vessel component are formed in a circular pattern along the upper vessel component and each are angled to direct the atmospheric air in a circular downward laminar air flow within the enclosed inner cavity.

In a preferred embodiment of the invention the plurality of apertures are angled about 10 degrees that operate to direct air flow along the inner vessel surface to promote a downward laminar air flow within the enclosed inner cavity.

In a preferred embodiment of the invention the plurality of apertures each have an inner diameter of about 0.093 in. (2.36 mm).

In a preferred embodiment of the invention the inner vessel surface of the vaporization body has a circular cross section.

In a preferred embodiment of the invention, the vaporization vessel and the fuel storage container are formed from a material suitable for use with liquid fuel, such as, but not limited to a high-density polyethylene, or steel, aluminum or brass.

In a preferred embodiment of the invention the wicking material is formed from a material operates to draw liquid fuel through the wicking material using capillary action to spread the liquid fuel (increase the amount of surface area of the liquid fuel exposed to air within the inner cavity) and increase the rate of vaporization of the liquid fuel.

In a preferred embodiment of the invention the wicking material is formed from a material resistant to decomposition or deterioration by the liquid fuel and operates when in contact with the liquid fuel to draw the liquid fuel using capillary action through the wicking material to increase the rate of vaporization of the liquid fuel.

In a preferred embodiment of the invention the wicking material is formed from conventional fuel filter paper.

In another preferred embodiment of the invention the wicking material is formed from fuel filter material made from a mixture of hardwood and softwood.

In another preferred embodiment of the invention the wicking material is formed from conventional automotive engine paper air filter material.

In a preferred embodiment of the invention the vaporization vessel includes a warm air inlet that operates to direct external warm air (air from outside the vaporization vessel) into the enclosed inner cavity of the vaporization vessel.

In preferred embodiment of the invention the warm air inlet operates to direct warm air entering into the enclosed inner cavity in a downward circular direction thereby increasing the rate of the vaporization of the liquid fuel.

In a preferred embodiment of the invention the fuel supply channel has an inner diameter of about 0.040 to about 0.062 in (1.016 mm-1.575 mm).

Another preferred embodiment of the invention is an enhanced fuel delivery system for use with a reciprocating engine that is effective for improving fuel usage, the system comprises a fuel storage container for storing a volume of liquid fuel; a vaporization vessel connected to the fuel storage container through a fuel supply channel that operates to direct liquid fuel from the fuel storage container to the vaporization vessel; wherein the vaporization vessel has a upper vessel component, a bottom vessel end and a vessel body having an inner vessel surface that together define an enclosed inner cavity. The enclosed inner cavity contains a central core structure with one or more openings and wicking material positioned around the central core structure. The wicking material is formed from a material that operates to draw liquid fuel entering the vaporization vessel through the fuel supply channel using capillary action such that the liquid fuel is vaporized transforming the liquid fuel into vapor. The fuel vapor is then directed through the one or more openings in the central core to an inner core passage and to a fuel line that operates to direct the fuel vapor to a fuel intake of the reciprocating engine. The upper vessel component of the vaporization vessel includes a plurality of apertures that operate to direct air from outside the vaporization vessel into the enclosed inner cavity and wherein the plurality of apertures are each angled to produce a downward air flow within the enclosed inner cavity. The inner vessel surface of the vessel body has a smooth continuous rounded configuration that is effective for maintaining laminar air flow within the enclosed inner cavity (minimizing turbulent air flow within the enclosed inner cavity).

Another preferred embodiment of the invention is a reciprocating engine having an enhanced fuel deliver system comprising a fuel storage container for containing and storing a quantity of liquid fuel, a vaporization vessel connected to the storage container through a fuel supply channel that operates to direct liquid fuel from the fuel storage container to the vaporization vessel, wherein the vaporization vessel has a central core structure and wicking material positioned around the central core structure. The wicking material operates to draw the liquid fuel entering the vaporization vessel through the wicking material by capillary action to transform the liquid fuel into vapor and whereby the fuel vapor is directed through one or more openings in the central core structure to an inner core passage to a fuel line that operates to direct the vapor to a fuel intake of the reciprocating engine.

Another preferred embodiment of the invention is an article comprising a reciprocating engine and an enhanced fuel deliver system, the enhanced fuel delivery system having a fuel storage container for storing a quantity of liquid fuel, a vaporization vessel connected to the fuel storage container through a fuel supply channel that operates to direct liquid fuel to flow through the fuel supply channel from the fuel storage container into the vaporization vessel. The vaporization vessel includes a central core structure and wicking material positioned around the central core structure that operates to draw liquid fuel entering the vaporization vessel through the wicking material by capillary action to transform the liquid fuel into vapor. The fuel vapor is directed through one or more openings in the central core structure to a inner core passage to a fuel line that operates to direct the fuel vapor to a fuel intake of the reciprocating engine.

Other objects, advantages and embodiments of the invention will be apparent from the following description, drawings and the appended claims.

BRIEF DESCRIPTION OF THE DRAWINGS

To provide a more complete understanding of the present invention and further features and advantages thereof, reference is now made to the following description taken in conjunction with the accompanying drawings, in which:

FIG. 4 is a side schematic view of the container top component showing the upper top portion, the stem portion and a pressurization conduit having a lower portion vapor chamber and an upper vapor release channel for releasing pressure through a top opening;

FIG. 5 is a schematic top view of the container top component of FIG. 4 showing the top opening;

DETAILED DESCRIPTION OF THE INVENTION

Figure 1:
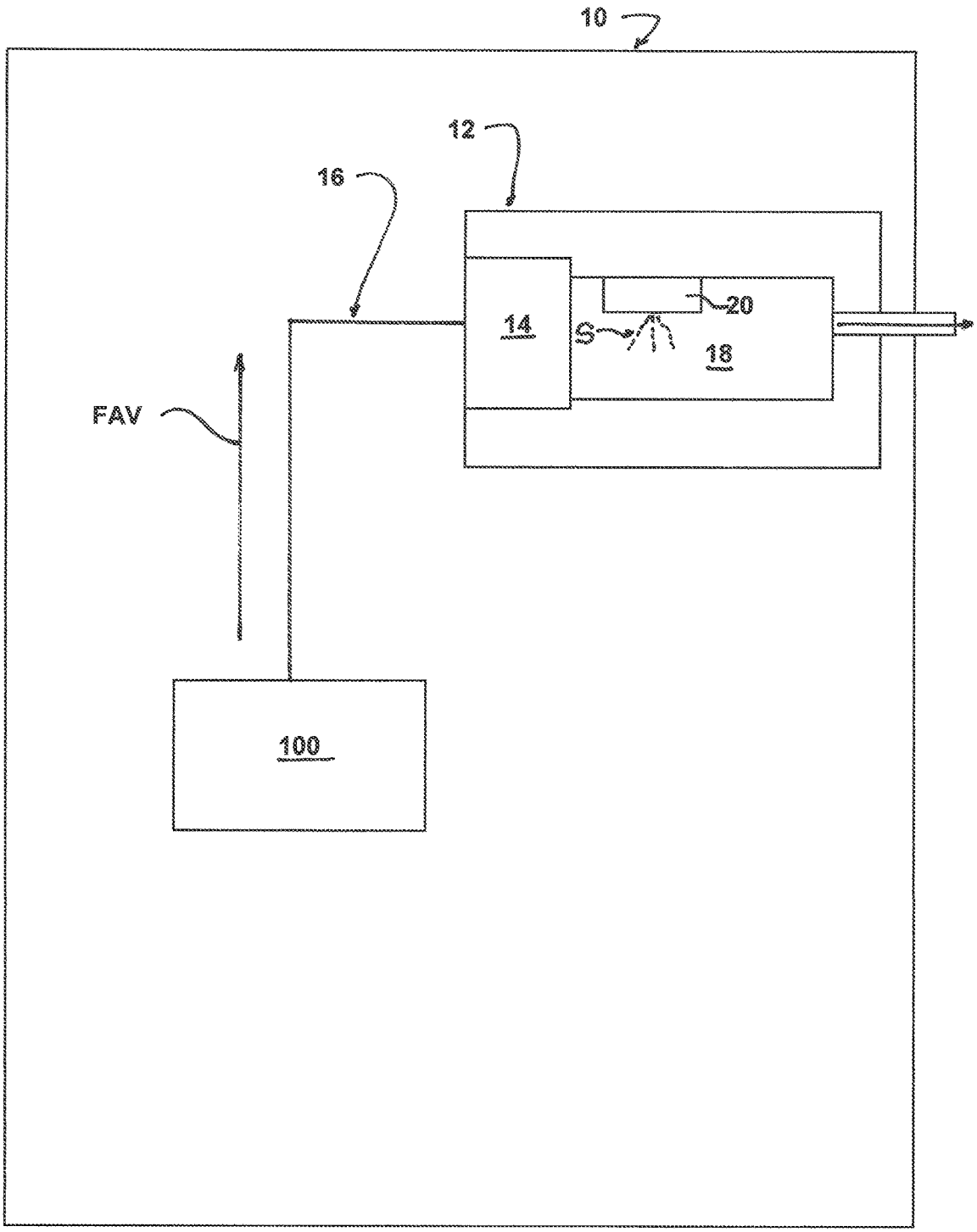
FIG. 1 is a schematic illustration showing an article having a reciprocating engine and the enhanced fuel delivery system of the subject invention connected to the reciprocating engine showing fuel that was transformed into a vapor by the enhanced fuel system being directed to a fuel intake of the reciprocating engine.

The present invention relates to an article having a reciprocating engine and, more particularly, to a new and novel enhanced fuel delivery system for use with a reciprocating engine. As used herein, the term "liquid fuel" refers to liquid fuels typically used with conventional reciprocating engines, such as gasoline, kerosene and other fuels having volatility sufficient to allow vaporization of the fuel as described below. It should be understood that as used herein "reciprocating engines" include various conventional internal combustion engines such as those used as portable engines for small electrical generators, home equipment such as lawn mowers, trimmers, cutting tools, and the like; and for use for small recreational vehicles such as small motorized vehicles, scooters, snowmobiles, outboard boat engines, and the like. In describing the preferred embodiments of the invention and as illustrated in the drawings, specific terminology will be resorted to for the sake of clarity. However, the invention is not intended to be limited to the specific terms so selected, and it is to be understood that each specific term includes all technical equivalents that operate in a similar manner to accomplish a similar purpose. It should be understood however that as used herein reciprocating engines do not include engines, such as conventional diesel engines, that require controlled ignition to minimize simultaneous combustion of the entire fuel spray immediately upon entry of the fuel in a cylinder unless systems are used to provide proper combustion within the combustion chamber.

As illustrated in FIG. 1, an article 10 having a conventional reciprocating engine 12 and an enhanced fuel delivery system of the subject invention, generally designated 100, is shown. The reciprocating engine 12 includes a fuel intake 14 that operates to receive fuel from a fuel line 16. Typically, in a conventional reciprocating engine fuel within the fuel intake is sprayed (atomized) to create a fine mist, such as by use of one or more fuel injectors, and mixed with air in one or more combustion chambers 18 where it is subjected to a spark from a spark plug or other ignition means which begins combustion of the fuel/air mixture. Since the operation of such conventional reciprocating engines is well known it therefore requires no additional elaboration. The article 10 of the subject invention includes a reciprocating engine 12 having an enhanced fuel delivery system 100 that operates to transform liquid fuel LF into a vapor that is then directed into the fuel intake 14 where it is subjected to a spark S from a spark plug 20 to begin combustion. The transformation of the liquid fuel into a vapor by the enhanced fuel delivery system operates to increase combustion efficiency and reduce fuel consumption and air pollution.

Referring to FIGS. 1-5, the enhanced fuel delivery system 100 is shown having a fuel storage container 102 for storing a quantity of liquid fuel LF and a vaporization vessel 104 for receiving liquid fuel from the fuel storage container 102 and promoting (cause) the vaporization of the liquid fuel and directing the vaporized fuel (fuel vapor) to the fuel intake 14 of the reciprocating engine 12. The fuel storage container 102 and the vaporization vessel 104 are each formed from a fuel resistant material, such as a high-density polyethylene plastic, or a metallic material, such as steel, aluminum or brass. The fuel storage container 102 has a storage container body 106 with a top end 108 and a closed bottom end 110, a container inner body surface 112 and a container outer body surface 114. Preferably, the fuel storage container 102 further includes a container top component 116 removably attached to the top end 108 of the storage container body 106 wherein the container inner body surface 112, the container top component 116 and the closed bottom end 110 cooperate together to form a container inner cavity 118 for containing a volumetric amount of fuel LF.

The container inner body surface 112 of the fuel storage container 102 preferably has a circular cross section with a container upper portion 120 of the top end 108 having an upper portion inner diameter CDU and a container lower portion 122 having a slightly smaller lower portion inner diameter CDL than that the container upper portion 120. In a preferred embodiment, the container upper portion inner diameter CDU of the container inner body surface 112 has a diameter of about 2.625 in (63.5 mm) and the container lower portion 122 has a lower portion diameter CDL of about 2.5 in. (63.5 mm). As shown, in FIGS. 4 and 5, the container top component 116 includes an upper portion 124 having an upper top surface 126 and a lower top surface 128 with a circular stem portion 130 integral with and extending perpendicular downwardly from the lower top surface 128. The stem portion 130 has one or more fuel resistant O-rings 132 concentrically mounted along the outer stem surface 134 of the circular stem portion 130 and which are sized to nest the stem portion 130 within the container upper portion 120 of the top end 108 and to seal against the rim 136 formed at the junction of the container upper portion 120 and the container lower portion 122 thereby providing a removable frictional tight seal that operates to prevent fuel from leaking out from the top end 108 of the storage container body 106. It should be understood that other systems for removably attaching the top component to the top end of the storage container body can be utilized, such as by screw threads projecting concentrically outwardly from the outer stem surface of the stem portion that operate to mate with corresponding inwardly projecting screw threads positioned along the inner body surface of the upper portion of the top end of the storage container body for releasably securing the top component to the top end of the storage container body. It should be understood that the removable container top component operates to allow a user to add additional liquid fuel into the fuel storage container when needed. As shown, in a preferred embodiment, the container top component 116 further includes a pressurization conduit 138 centrally positioned and longitudinally extending through the stem portion 130 and the upper top portion 124 of the container top component 116 that operates to allow vapor to escape outwardly through a top opening 140 in the container top component 116 to reduce pressure build-up in the container inner cavity 118 such as during periods of non-use or increased temperature or to allow outside air to flow into the container inner cavity 118 during use to permit fuel to flow smoothly out of the container inner cavity 118 through a fluid supply channel 146. Preferably, the pressurization conduit 138 includes a lower portion vapor chamber 142 that operates to contain any fuel vapor that may be created by the liquid fuel contained within the container inner cavity 118 that may accumulate, and an upper vapor release channel 144 that extends from the lower portion vapor chamber 142 to direct accumulated fuel vapor to escape to the outside atmosphere through the top opening 140 in the container top component 116. It should be understood that the diameter of the upper release vapor release channel 144 and the top opening 140 are sized to control the pressure within the container inner cavity 118 such that excessive pressure does not build within the container inner cavity while allowing pressure to help in directing liquid fuel to flow out of the fuel storage container 102 into the vaporization vessel 104 through the fuel supply channel 146. In a preferred embodiment, the lower portion vapor chamber 142 has a circular cross-section with an inner diameter of about 0.5 in. (12.7 mm) and the upper vapor release channel 144 and the top opening 140 have a circular cross-section with an inner diameter of about 0.062 in (1.575 mm).

As shown in FIGS. 2 and 6-8, the vaporization vessel 104 includes a vaporization body 148 having an outer vessel surface 150, an inner vessel surface 152, an upper vessel component 154, and a bottom vessel end 156. The inner vessel surface 152, the upper vessel component 154 and the bottom vessel end 156 cooperate together to define an enclosed inner cavity 158. As illustrated, positioned along the lower end 160 of the container inner cavity 118, just above the closed bottom end 110, of the fuel storage container 102, is the fuel supply channel 146 that operates to provide a conduit whereby liquid fuel stored within the container inner cavity 118 of the fuel storage container 102 flows into the vessel lower end 162 of the enclosed inner cavity 158 of the vaporization vessel 104. The fuel supply channel preferably has a circular cross section that in combination of its length and its inner diameter are selected to provide the desire rate of fuel traveling through the fuel supply channel and entering into the enclosed inner cavity of the vaporization vessel. It was surprising found that the length of about 0.5 in. (12.7 mm) and an inner diameter of about 0.40 to about 0.062 in (1.016-1.575 mm) provides the optimum flow rate of fuel flow leaving the container inner cavity of the fuel storage container and flowing into the enclosed inner cavity of the vaporization vessel.

Positioned within the enclosed inner cavity 168 of the vaporization vessel 104 is a longitudinally extending central core structure 164 and wicking material 166 concentrically spaced around the central core structure 164. The central core structure 164 includes an inner core passage 168 with one or more openings 170 that extend from the enclosed inner cavity 158 to the inner core passage 168. As shown, the inner core passage 168 extends outwardly through the bottom vessel end 156 and connects to the fuel line 16 of the reciprocating engine 12. In a preferred embodiment of the invention the wicking material is formed from conventional fuel filter paper. In another preferred embodiment of the invention, the wicking material is formed from fuel filter material made from a mixture of hardwood and softwood. In another preferred embodiment of the invention the wicking material is formed from conventional automotive engine paper air filter material. It should be understood that other materials that are resistant to deterioration caused by exposure to liquid fuel and operate to draw the liquid fuel through the wicking material by capillary action to increase the surface area of the liquid fuel to air within the enclosed inner cavity thereby increasing the rate of vaporization of the liquid fuel can be utilized.

The inner vessel surface 152 of the vaporization vessel 104 preferably has a circular cross section with a vessel body upper end 184 having a vessel inner diameter VDU and a vessel body lower end 162 having a slightly smaller inner vessel diameter VDL than that the vessel body upper end 184. In a preferred embodiment, the vessel inner diameter VDU of the vessel body upper end 184 has a diameter of about 2625 in. (66.675 mm) and the vessel body lower end 162 has a diameter VDL of about 2.5 in or 63.5 mm). In a preferred embodiment of the invention the upper vessel component 154 includes an upper section 172 having an upper section top surface 174 and a lower section top surface 176 with a circular vessel stem portion 178 integral with and extending perpendicularly downwardly from the lower section top surface 174. The vessel stem portion 178 has one or more fuel resistant vessel O-rings 180 concentrically mounted along the outer vessel stem surface 182 of the circular vessel stem portion 178 and which are sized to nest within the upper section 172 of the vessel body upper end 184 against a vessel rim 183 formed between the vessel body upper end 184 and the vessel body lower end 162 to provide a removable frictional tight seal for preventing fuel or fuel vapor from leaking out from the vessel body upper end 184 of the vaporization vessel 104. It should be understood that other systems for removably attaching the upper vessel component to vaporization body 148 can be utilized, such as by screw threads projecting concentrically outwardly from the outer vessel stem surface of the vessel stem portion that operate to mate with corresponding inwardly projecting screw threads positioned along the inner vessel surface of the vessel body upper end for releasably securing the upper vessel component to the vessel body upper end.

Figure 8:
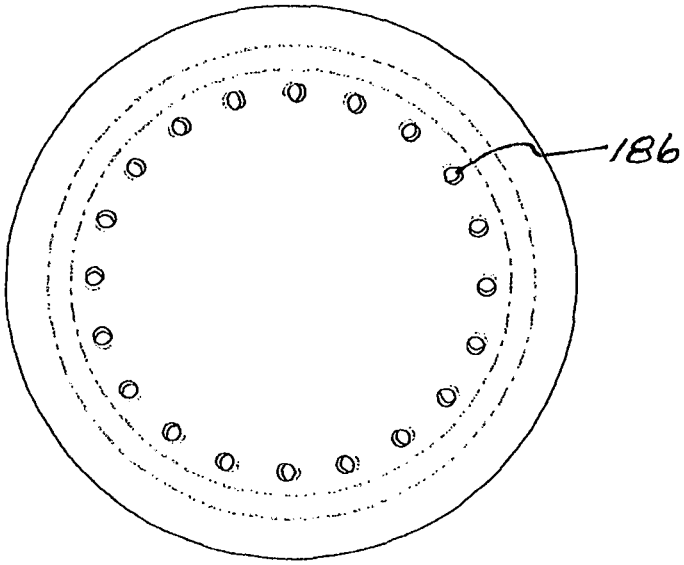
FIG. 8 is a schematic top view of the upper vessel component of the vaporization vessel having a plurality of apertures that operate to direct air from outside the vaporization vessel to enter into the enclosed inner cavity.
Figure 7:
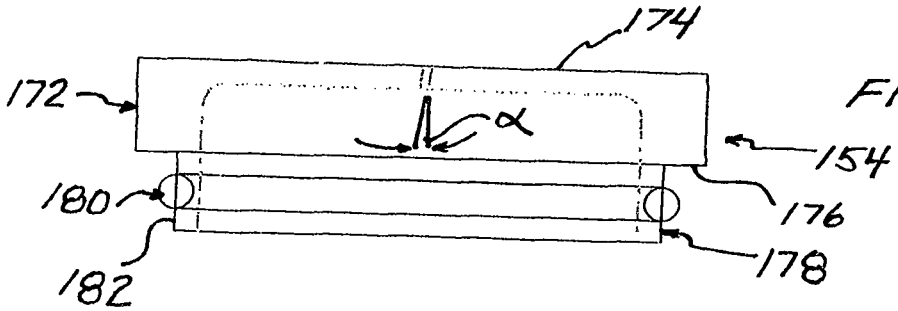
FIG. 7 is a schematic side view of the vaporization upper vessel component.
Figure 10:
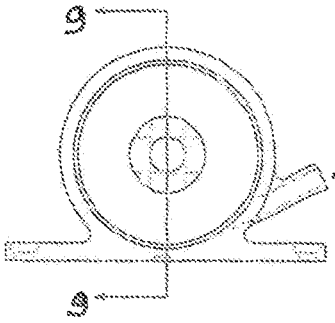
FIG. 10 is a schematic top view of the vaporization vessel showing the warm air inlet creating a downward circular motion air flow within the enclosed inner cavity.
Figure 9:
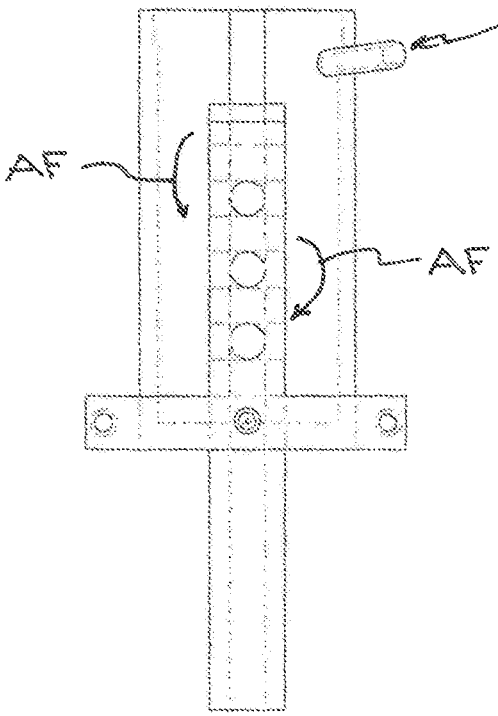
FIG. 9 is a schematic side cross-section view taken along section 9-9 of FIG. 10 showing another embodiment of the invention showing a warm air inlet for directing warm air in a downward circular motion within the enclosed inner cavity of the vaporization vessel.

Referring to FIGS. 7 and 8, the upper vessel component 154 of the vaporization vessel 104 includes a plurality of apertures 186 arranged in a circular pattern that extend through the upper vessel component 154 and operate to direct air from outside the vaporization vessel 104 to the enclosed inner cavity 158. The inner vessel surface 152 of the vaporization body 148 has a smooth continuous rounded configuration effective for producing a smooth air flow (laminar air flow) within the enclosed inner cavity 158 and minimizing the amount of turbulent flow. Preferably, the plurality of apertures 186 are each angled through the upper vessel component to direct the air flow downwardly along the inner vessel surface to enhance the smooth air flow within the enclosed inner cavity. In a preferred embodiment of the invention, each of the plurality of apertures are angled such that the angle $\alpha$ is about 10 degrees and have an inner diameter of about 0.093 in. (2.362 mm) thereby directing air entering the enclosed inner cavity in a downward circular flow direction creating a laminar air flow within the enclosed inner cavity. In another preferred embodiment of the invention, as illustrated in FIGS. 9 and 10, the vaporization vessel 104 includes a warm air inlet 188 that operates to direct warm air, such as air warmed by the operation of the reciprocating engine or air directed from the engine exhaust, in a generally downward circular direction towards the bottom vessel end 156 of the enclosed inner cavity 158. Preferably, the warm air inlet 188 is angled such that the air is directed downwardly and cooperates with the inner vessel surface 152 to create smooth circular laminar (non-turbulent air flow) flow within the enclosed inner cavity 158. In a preferred embodiment, the air entering the enclosed inner cavity 158 through the warm air inlet 188 is pressurized to create sufficient pressure within the enclosed inner cavity 158 to move fuel vapor mixed with air within the enclosed inner cavity to create a fuel/air mixture within the enclosed inner cavity 158 out through the one or more openings 170 in the central core structure 164 and through the fuel line 16 and to the fuel intake 14 of the reciprocating engine 12. It should now be understood that the number of the plurality of apertures 172 and the size of the warm air inlet 174 can be adjusted to provide the proper fuel/air vapor ratio and pressurization for the particular reciprocating engine and the particular fuel being utilized.

Figure 6:
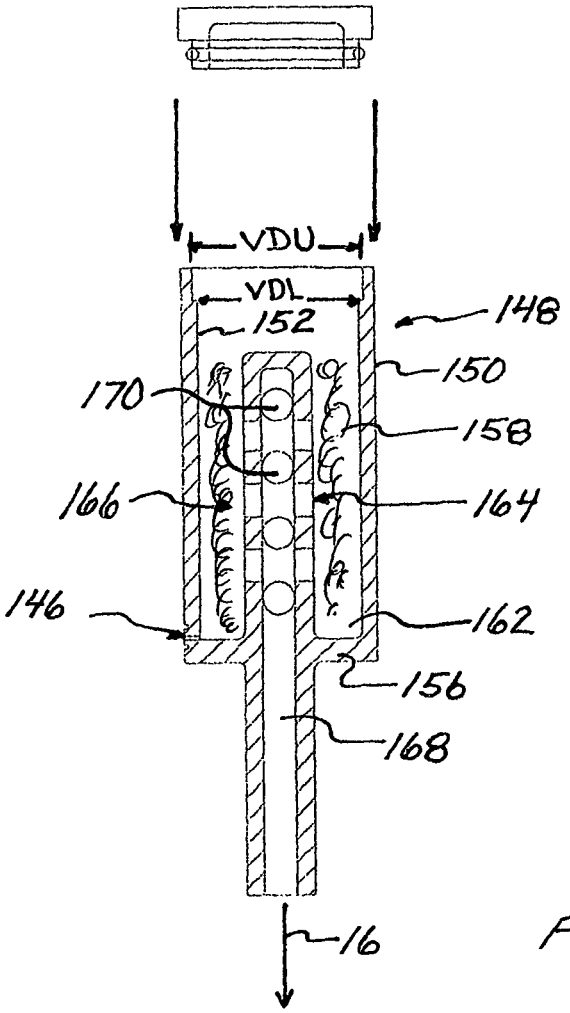
FIG. 6 is a schematic cross-sectional exploded view of the vaporization vessel having an enclosed inner cavity with a central core structure with one or more openings and wicking material within the enclosed inner cavity of the vaporization vessel, a fuel supply channel that operates to direct liquid fuel from the fuel storage container to flow into the vaporization vessel and a removable vaporization upper vessel component.

As shown in FIG. 6, the wicking material 166 is preferably positioned concentrically around the central core structure 164 and operates to draw liquid fuel, using capillary pressure, entering into the enclosed inner cavity 158 through the fuel supply channel 146 upwardly through the wicking material 166 to increase the surface area of the liquid fuel exposed to the air flow AF within the enclosed inner cavity 158 such that the liquid fuel is vaporized to create a fuel/air vapor FAV which is then directed through the one or more openings 170 of the central core structure 164 where it is then directed to the fuel intake 14 by the fuel line 16.

Figure 2:
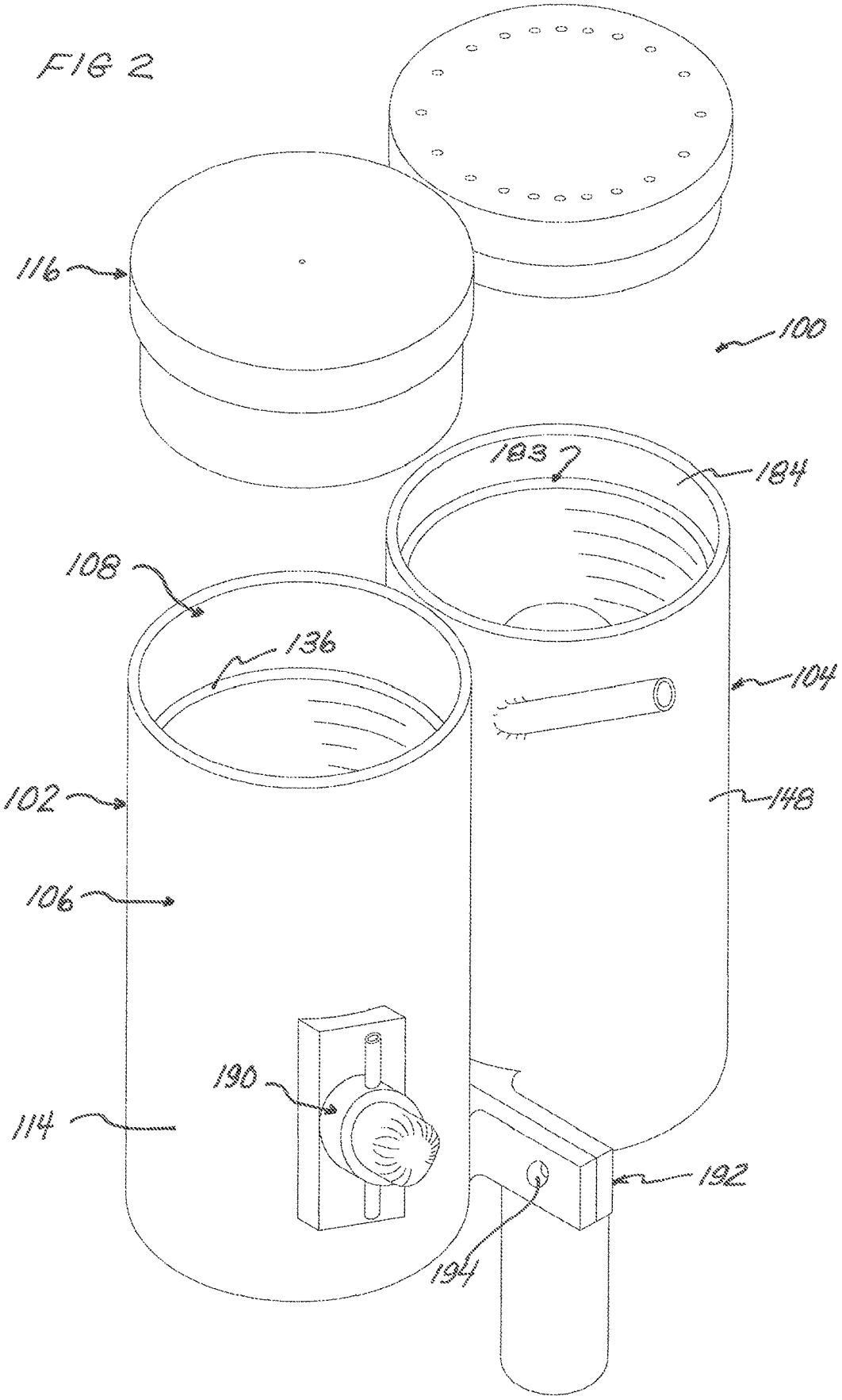
FIG. 2 is a schematic perspective exploded illustration showing the enhanced fuel delivery system of FIG. 1 having a fuel storage container with a removable container top component and a vaporization vessel having a removable upper vessel component, a primer pump and a mounting brace for attaching the enhanced fuel delivery system to a structure of the article or the reciprocating engine.
Figure 3:
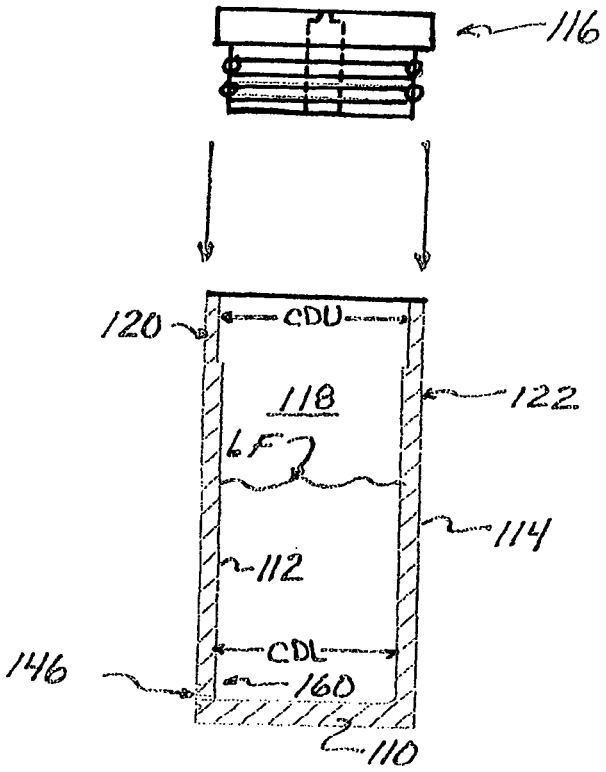
FIG. 3 is a schematic cross-sectional exploded view of the fuel storage container having a removable container top component and a fuel supply channel that operates to permit liquid fuel to flow from the fuel storage container into the vaporization vessel.

Referring to FIG. 2, in a preferred embodiment of the invention, mounted to the container outer body surface 114 of the fuel storage container 102 is a conventional primer pump 190 that operates to force liquid fuel within the container inner cavity 118 by means of a one-way flow valve (not shown) to flow directly into the enclosed inner cavity 158 of the vaporization vessel 104 until operation of the reciprocating engine creates pressure within the enclosed inner cavity, such as by way of the warm air inlet.

In a preferred embodiment of the invention, the fuel storage container 102 and the vaporization vessel 104 include a mounting brace 192 having one or more threaded holes 194 that can be placed in position to align with holes in a support structure (not shown) for receiving a screw, bolt or the like for securing attaching the enhanced fuel delivery system 100 to the article or to the reciprocating engine. It should be understood that the enhanced fuel delivery system of the subject invention can include various other attachment and support structures that can operate to position the enhanced fuel delivery system at various locations on the article or the engine structure.

Figure 11:
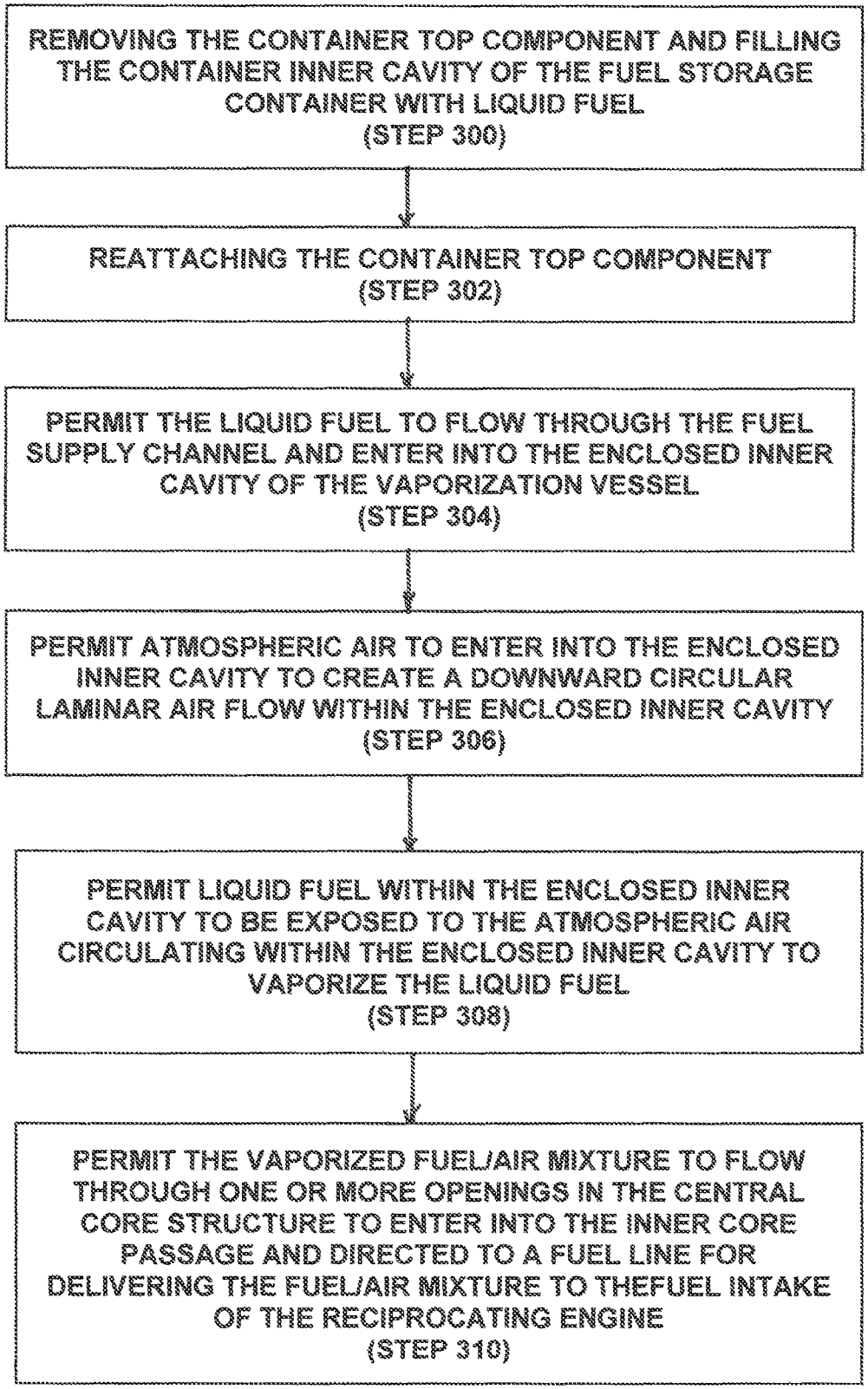
FIG. 11 is a flow diagram showing a preferred method of the subject invention whereby liquid fuel is vaporized and directed to the intake of a reciprocating engine.

Referring to FIG. 11, in operation of the enhanced fuel delivery system of the subject invention, liquid fuel is provided by a user removing the container top component from its bested position on the storage container body and pouring fuel into the container inner cavity (Step 300) and reattaching the container top component into its nested position on the storage container body (Step 302). Once the container inner cavity is filled with liquid fuel, the liquid fuel flows from the container inner cavity to the enclosed inner cavity through the fuel supply channel (Step 304) by force of gravity or by pressure created by the fuel within the container inner cavity or induced into the container inner cavity by use of the primer pump. Atmospheric air (air from outside the vaporization vessel) is drawn into the enclosed inner cavity through the plurality of apertures in the upper vessel component and the warm air inlet creating a laminar air flow within the enclosed inner cavity (Step 306). Liquid fuel that has entered the enclosed inner cavity of the vaporization vessel contacts the wicking material within the enclosed inner cavity where it drawn upwardly through the wicking material by capillary action thereby increasing the amount of fuel surface exposed to the circulating air flow within the enclosed inner cavity (Step 308) and increasing the vaporization rate of the liquid fuel to its desired rate. The vaporized liquid fuel is mixed with air within the enclosed inner cavity forming a fuel/air vapor mixture which enters the inner core passage through the one or more openings where it is directed to the fuel intake of a reciprocating engine by a fuel line (Step 310).

It should now be apparent to one skilled in the art that an article having a reciprocating engine and the enhanced fuel delivery system of the subject invention operates whereby fuel can be stored in its liquid state and converted into a vapor state prior to being introduced into the combustion chamber of the reciprocating engine thereby increasing combustion efficiency and reducing fuel consumption and air pollution. It should also now be understood that the enhanced fuel delivery system can be easily utilized for use with small apparatus having reciprocating engines, such as emergency generators, that operate in limited space. By transforming the liquid fuel into a vapor and mixing the fuel vapor with the appropriate amount of air to create a desired fuel/air vapor mixture, operates to increase fuel utilization of the engine thereby allowing for a reduced amount of fuel to be stored or allows for increased time of operation of the engine for a given amount of stored liquid fuel. Further, by transforming the fuel from a liquid state to a vapor state and creating a desired fuel/air mixture allows for more efficient combustion thereby reducing the amount of un-burned fuel and pollutants that are expelled into the atmosphere.

The invention claimed is:

1. An enhanced fuel delivery system for use with a reciprocating engine, the enhanced fuel delivery system comprising:

a fuel storage container for storing a quantity of liquid fuel;

a vaporization vessel having an inner vessel surface and an outer surface and connected to said fuel storage container through a fuel supply channel that operates to transfer liquid fuel stored in said fuel storage container to flow into said vaporization vessel;

wherein said vaporization vessel includes a central core structure and wicking material positioned between said inner surface of said vaporization vessel and said central core structure such that said wicking material is concentrically spaced around said central core structure, whereby the wicking material operates to draw the liquid fuel entering said vaporization vessel through said wicking material transforming the liquid fuel into vapor;

wherein said vaporization vessel has an upper vessel component includes a plurality of apertures sized and angled such that they operate to direct air from outside said vaporization vessel into said vaporization vessel and create a laminar air flow within said vaporization vessel;

wherein said central core structure has an inner core passage and one or more openings that operate such that said vapor is directed through said one or more openings in said central core structure to said inner core passage and out to a fuel line that operates to direct said vapor to a fuel intake of the reciprocating engine.

2. The enhanced fuel delivery system of claim 1 wherein said inner vessel surface of said vaporization vessel has a continuous rounded configuration so that laminar airflow within said vaporization vessel is created and wherein said apertures are angled to direct air flow along said inner vessel surface to enhance laminar air flow within said vaporization vessel.

3. The enhanced fuel delivery system of claim 2 wherein said plurality of apertures formed along said upper vessel component are formed in a circular pattern along said upper vessel component.

4. The enhanced fuel delivery system of claim 2 wherein said plurality of apertures formed along said upper vessel component are formed in a circular pattern along said upper vessel component and are each angled to direct air such that it flows downwardly and along said inner vessel surface as laminar air flow.

5. The enhanced fuel delivery system of claim 2 wherein said plurality of apertures are angled to minimize the amount of turbulent air flow within said enclosed inner cavity.

6. The enhanced fuel delivery system of claim 1 wherein said vaporization vessel and said fuel storage container are formed from a material suitable for use with liquid fuel.

7. The enhanced fuel delivery system of claim 1 wherein said wicking material is formed from a material that operates to draw liquid fuel through the wicking material using capillary action to increase the surface area of said liquid fuel exposed to air and increase the rate of vaporization of the liquid fuel.

8. The enhanced fuel delivery system of claim 1 wherein said wicking material is formed from conventional fuel filter paper.

9. The enhanced fuel delivery system of claim 1 wherein said wicking material is formed from fuel filter material made from a mixture of hardwood and softwood.

10. The enhanced fuel delivery system of claim 1 wherein said wicking material is formed from conventional automotive engine paper air filter material.

11. The enhanced fuel delivery system of claim 1 wherein said vaporization vessel includes a warm air inlet that operates to direct warmed by the reciprocating engine into said enclosed inner cavity of said vaporization vessel.

12. The enhanced fuel delivery system of claim 11 wherein said warm air inlet operates to direct warm air into said enclosed inner cavity in a downward circular direction.

13. The enhanced fuel delivery system of claim 1 wherein said fuel storage container has an inner body surface having a circular cross section with a diameter of 2.625 in (63.5 mm) and a lower portion diameter of 2.5 in (63.5 mm) and wherein said vaporization vessel has a circular cross section with a vessel inner diameter of 2.5-2.625 in (63.5-66.675 mm) and wherein a fuel supply channel connecting said fuel storage container to said vaporization vessel that operates to deliver liquid fuel from said fuel storage container to said vaporization vessel has an inner diameter of 0.40-0.062 in (1.016-1.575 mm) and a length of 0.5 in (12.7 mm).

14. An enhanced fuel delivery system for use with a reciprocating engine that is effective for improving fuel usage, the enhanced fuel delivery system comprises:

a fuel storage container for storing a volume of liquid fuel;

a vaporization vessel connected to said fuel storage container through a fuel supply channel that operates to direct liquid fuel from said fuel storage container to said vaporization vessel;

wherein said vaporization vessel has an upper vessel component, a bottom vessel end and a vessel body having an inner vessel surface that together define an enclosed inner cavity;

wherein said enclosed inner cavity has a central core structure with one or more openings and wicking material positioned around said central core structure;

wherein said wicking material is formed from a material that operates to draw liquid fuel entering said vaporization vessel through said fuel supply channel using capillary action such that said liquid fuel is vaporized transforming said liquid fuel into fuel vapor;

wherein said upper vessel component of said vaporization vessel includes a plurality of apertures that operate to direct air from outside said vaporization vessel into said enclosed inner cavity and wherein said plurality of apertures are each angled to produce laminar air flow within said enclosed inner cavity;

wherein said inner vessel surface of said vessel body has continuous rounded configuration that is effective for maintaining laminar air flow within said enclosed inner cavity; and wherein said fuel vapor is then directed through said one or more openings in said central core structure to an inner core passage to a fuel line that operates to direct the fuel vapor to a fuel intake of the reciprocating engine.

15. An article having a reciprocating engine having an exhaust system and with an enhanced fuel deliver system, the enhanced fuel delivery system comprises:

a fuel storage container for containing and storing a quantity of liquid fuel;

a vaporization vessel having an inner vessel surface and an inner vessel end and is connected to said storage container through a fuel supply channel that operates to direct said liquid fuel from said fuel storage container to said vaporization vessel;

wherein said vaporization vessel has an upper vessel component having a plurality of apertures sized and angled such that they operate to direct air from outside said vaporization vessel into said vaporization vessel and along said inner vessel surface to create a laminar air flow within said vaporization vessel and minimize the amount of turbulent air flow within said vaporization vessel; and wherein said vaporization vessel has a central core structure and wicking material positioned around said central core structure such that it is between said inner vessel surface and said central core structure, wherein said wicking material operates to draw said liquid fuel entering said vaporization vessel through said wicking material by capillary action to transform said liquid fuel into fuel vapor and whereby said fuel vapor is directed through one or more openings in said central core structure to an inner core passage and out to a fuel line that operates to direct said fuel vapor to a fuel intake of the reciprocating engine.

16. The enhanced fuel delivery system of claim 15 wherein said plurality of apertures are angled to direct air in a circular flow direction.

17. The enhanced fuel delivery system of claim 15 wherein said wicking material is formed from conventional fuel filter paper.

18. The enhanced fuel delivery system of claim 15 wherein said wicking material is formed from fuel filter material made from a mixture of hardwood and softwood.

19. The enhanced fuel delivery system of claim 15 wherein said wicking material is formed from conventional automotive engine paper air filter material.

20. The enhanced fuel delivery system of claim 15 wherein said vaporization vessel includes a warm air inlet that operates to direct external air heated by the operation of the reciprocating engine or the exhaust system into said vaporization vessel and further operates to direct said heated air towards said bottom vessel end in a circular direction and is angled to cooperate with said inner vessel surface to create circular laminar air flow within the vaporization vessel.

* * * * *